US011272768B1

(12) United States Patent
HerreraVillar

(10) Patent No.: US 11,272,768 B1
(45) Date of Patent: Mar. 15, 2022

(54) BACKPACK CHAIR

(71) Applicant: Carlos HerreraVillar, Alameda, CA (US)

(72) Inventor: Carlos HerreraVillar, Alameda, CA (US)

( * ) Notice: Subject to any disclaimer, the term of this patent is extended or adjusted under 35 U.S.C. 154(b) by 10 days.

(21) Appl. No.: 17/011,775

(22) Filed: Sep. 3, 2020

(51) Int. Cl.
*A45C 9/00* (2006.01)
*A45F 4/02* (2006.01)
*A47C 13/00* (2006.01)

(52) U.S. Cl.
CPC ..... *A45C 9/00* (2013.01); *A45F 4/02* (2013.01); *A47C 13/00* (2013.01); *A45C 2009/002* (2013.01); *A45F 2004/026* (2013.01)

(58) Field of Classification Search
CPC ..... A45C 9/00; A45C 2009/002; A45F 4/02; A45F 2004/026; A47C 13/00
See application file for complete search history.

(56) References Cited

U.S. PATENT DOCUMENTS 3,690,525 A * 9/1972 Koons ..... B60N 2/286 224/155
3,779,599 A * 12/1973 Gottfried ..... B60N 2/2827 297/253
4,392,598 A * 7/1983 Dixon ..... A45F 4/02 224/155
5,161,722 A * 11/1992 Hembree ..... A45F 3/08 224/148.2
5,209,381 A * 5/1993 Jay ..... A45F 4/02 224/155
5,573,155 A * 11/1996 Sadler ..... A45F 4/02 224/155
5,733,000 A * 3/1998 Stump ..... A47C 4/52 297/188.06
6,052,939 A * 4/2000 McClain ..... A01K 97/22 206/315.11
6,145,716 A * 11/2000 Caicedo ..... A45F 3/04 224/155
6,698,830 B1 * 3/2004 Gaines ..... A47C 15/004 297/183.5
9,591,924 B1 * 3/2017 O'Neal ..... A01K 97/10
10,051,947 B2 * 8/2018 Sisante ..... A45F 4/02
10,575,658 B2 * 3/2020 Romero ..... A47D 1/10
2004/0189062 A1 * 9/2004 Knight ..... A47C 9/10 297/188.08
2008/0302840 A1 * 12/2008 Missick ..... A45F 4/02 224/155

(Continued)

*Primary Examiner* — Brian D Nash

(57) ABSTRACT

In one example, a backpack chair includes a U-shaped frame to form a base for the backpack chair. The U-shaped frame has two sides connected to each other by a semicircular section. In a sitting mode where the backpack chair is for sitting, the two sides of the U-shaped frame extend in a horizontal plane and the semicircular section extends in a substantially vertical plane. In a backpack mode where the backpack chair is carried as a backpack, the two sides extend in a vertical plane and the semicircular section extends in a substantially horizontal plane. The backpack chair comprises a top member that includes a combined seat and back support for the U-shaped frame. In the sitting mode, the top member is attached to the U-shaped frame, and in the backpack mode, the top member is detached from the U-shaped frame.

19 Claims, 7 Drawing Sheets

(56) References Cited

U.S. PATENT DOCUMENTS

| | | | | |
|---|---|---|---|---|
| 2015/0313348 | A1* | 11/2015 | Kriemelmeyer | A47B 3/10 224/155 |
| 2016/0058192 | A1* | 3/2016 | Drew | A47C 7/008 297/4 |
| 2017/0065062 | A1* | 3/2017 | Wang | A45F 4/02 |
| 2019/0374033 | A1* | 12/2019 | Grace | A45F 3/14 |
| 2020/0000209 | A1* | 1/2020 | Steele | A45F 3/06 |
| 2020/0315327 | A1* | 10/2020 | Jones | A45F 3/04 |
| 2021/0045535 | A1* | 2/2021 | Wilcox | B65D 81/3813 |
| 2021/0093088 | A1* | 4/2021 | Downs | A47C 1/14 |

* cited by examiner

BACKPACK CHAIR

BACKGROUND

A physical brick and mortar location may be used by hair care providers to provide hair care services. For example, a barber may provide hair cutting services in a barber shop. Customers desiring hair cutting services can visit the barber shop to have services performed. At the barber shop, hair care services may be performed on a barber chair. The barber chair is itself specially designed for barbershops and may have a backrest, a footrest and a hydraulic mechanism for performing chair height adjustments.

BRIEF DESCRIPTION OF THE DRAWINGS

Examples of the disclosure will be rendered by reference to specific examples which are illustrated in the appended drawings. The drawings illustrate only particular examples of the disclosure and therefore are not to be considered to be limiting of its scope. The principles here are described and explained with additional specificity and detail through the use of the accompanying drawings.

DETAILED DESCRIPTION

As noted above, hair care customers may visit a brick and mortar barber shop to receive hair care services. However, at other times, the hair care professional may make a house call. For example, a barber may visit a customer's home, office or other location outside of the barber shop to perform hair care services. The barber cannot travel with his or her barber chair to the remote location. The barber chair is large, heavy and is permanently installed in the barber shop. Also, in many cases, it is unclear whether the customer can provide a chair, much less an adequate chair that can be used to perform services. If a chair is unavailable, hair care services cannot be performed and the barber must return to his or her shop causing loss of revenue and time. In addition, when the barber travels to a remote location, the barber may need to locate a suitable bag to store and transport hair care implements such as cutting tools, lights, mirrors, etc.

Accordingly, an example of the present invention provides a backpack chair that can utilized in a sitting mode for hair care services as well as in a backpack mode. In one example, the backpack chair has a U-shaped frame to form a base for the backpack chair. The U-shaped frame has two sections or sides connected to each other by a semicircular section. The two sides of the U-shaped frame may extend in a horizontal plane and the semicircular section may extend in a substantially vertical plane when the backpack chair is used in the sitting mode. And in the backpack mode where the backpack chair is carried as a backpack, the two sides extend in a vertical plane and the semicircular section extends in a substantially horizontal plane.

The backpack chair also includes a top member that includes a combined seat and back support for the U-shaped frame. In the sitting mode, the top member is attached to the U-shaped frame, and in the backpack mode, the top member is detached from the U-shaped frame.

Another example of the present invention is a chair having a frame to form a base for the chair. The frame need not be U-shaped as in the example above. The frame has walls to form a receptacle. In a sitting mode, the walls of the frame extend from a surface that receives a seat to a position on the ground to form legs for the chair. In a backpack mode, the walls of the frame extend in a vertical plane and no portion of the walls touch the ground when the chair is carried.

In this example, the chair may have a top member that includes a combination of the seat and back support for the frame. In the sitting mode, the top member is attached to the frame, and in the backpack mode, the top member is detached from the frame and stored in the receptacle formed by the frame.

Figure 1:
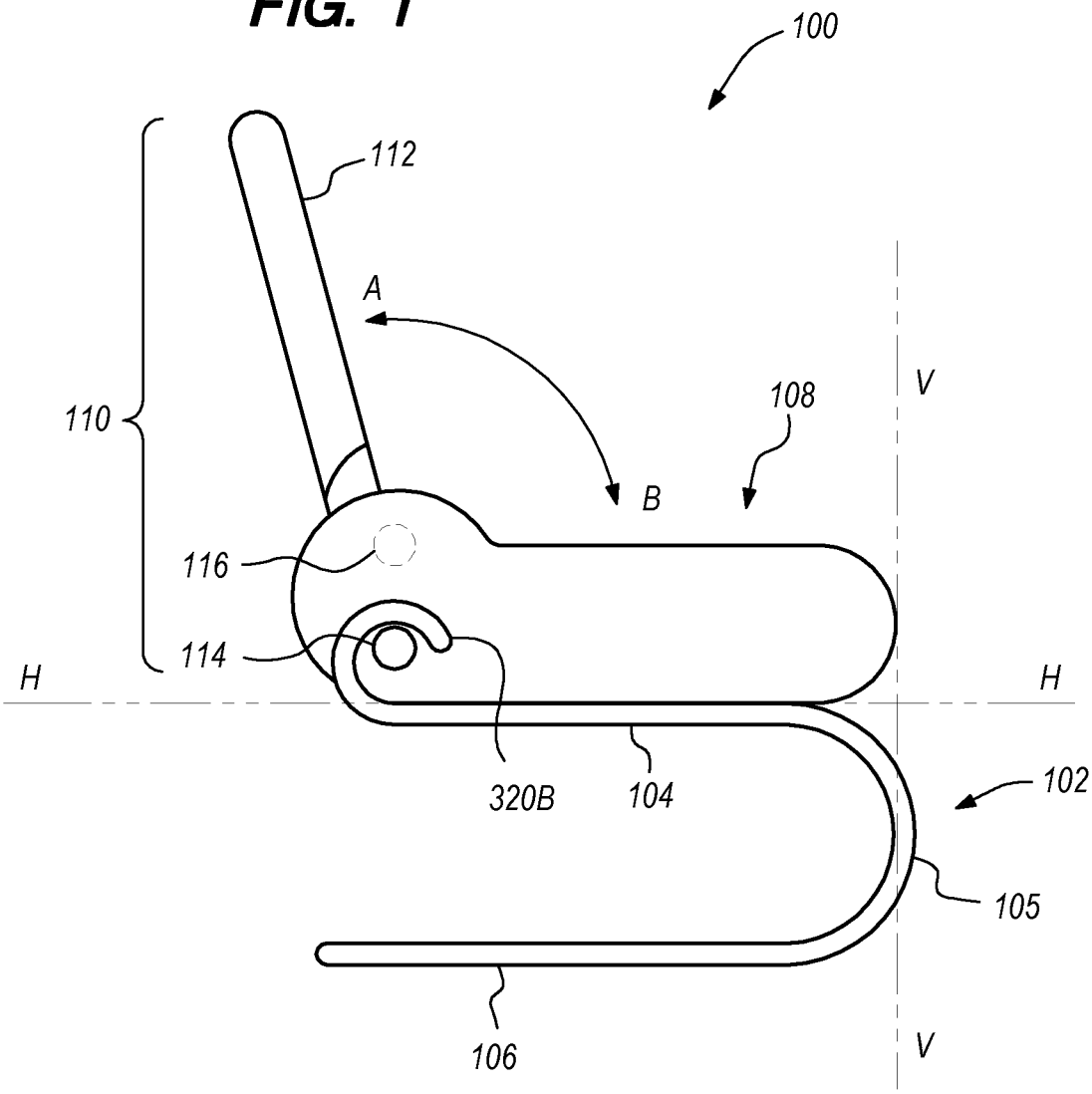
FIG. 1 illustrates a backpack chair according to an example of the present disclosure.

FIG. 1 illustrates a backpack chair 100 according to an example of the present disclosure.

In FIG. 1, backpack chair 100 includes a U-shaped frame 102 to form a base for backpack chair 100. Although not shown, U-shaped frame 102 may be other shapes consistent with the principles and precepts of the present disclosure. For example, U-shaped frame 102 may be rectangular. In another example, U-shaped frame 102 may be circular. In yet another example, U-shaped frame 102 may be polygonal.

In the example of FIG. 1, U-shaped frame 102 has two sides (or sections) including a first side 104 and a second side 106 that are connected to each other by a semicircular section 105. This U-shaped frame 102 can be used in any one of two modes including a backpack mode and a sitting mode. As implied by its name, a sitting mode is a mode in which backpack chair 100 is disposed for sitting. That is, U-shaped frame 102 of backpack chair 100 is positioned to support a customer that is sitting during a hair cutting service.

More specifically, in this sitting mode, second side 106 of U-shaped frame 102 is positioned on the ground to form legs of backpack chair 100 as shown while first side 104's surface is positioned to receive the seat 108. In other words, in the sitting mode, first side 104 and second side 106 extend in a horizontal plane H while semicircular section 105 extends in a substantially vertical plane V. Vertical plane V and horizontal plane H are more clearly shown in FIGS. 2 and 3.

Figure 2:
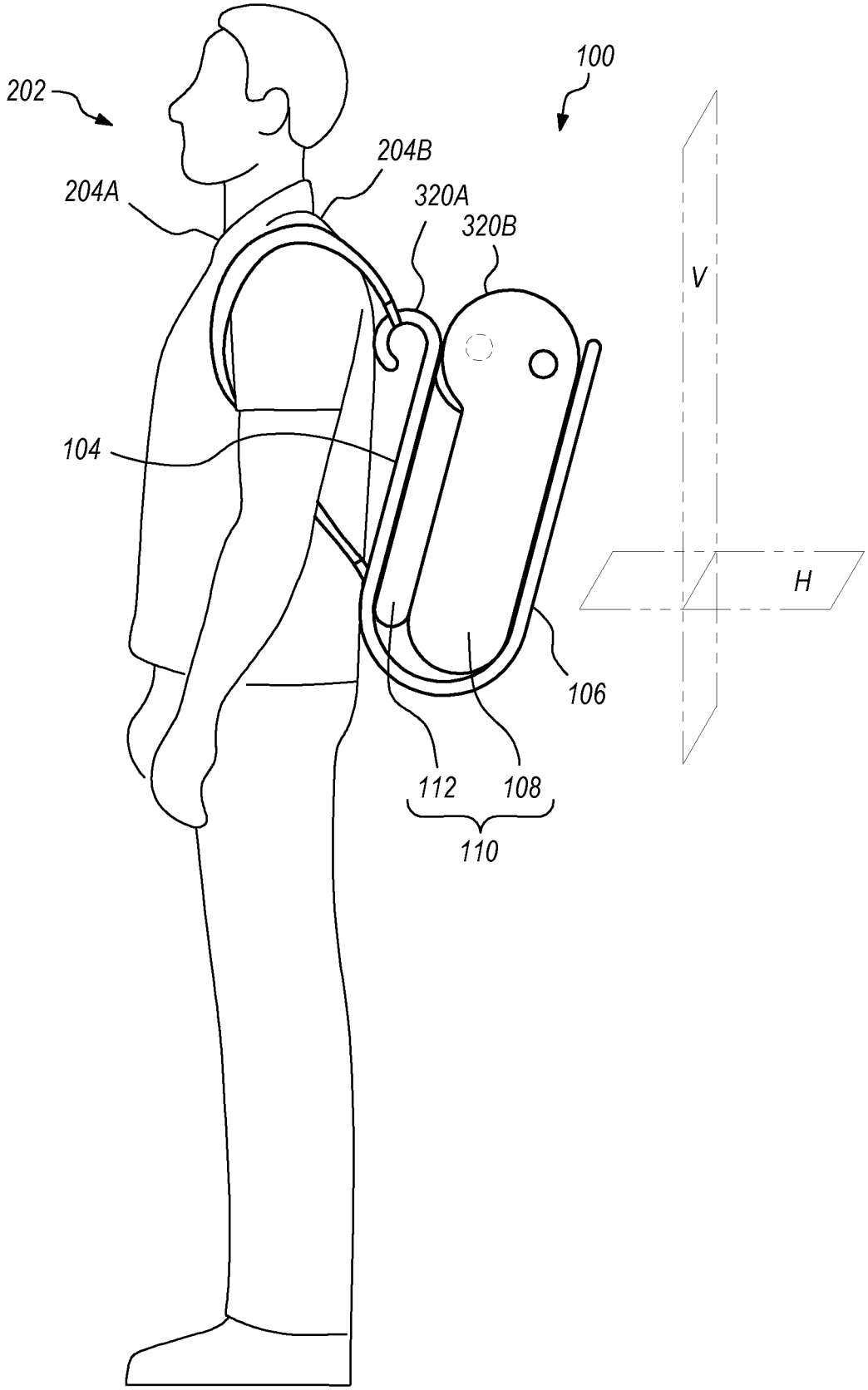
FIG. 2 illustrates the backpack chair of FIG. 1 in an example backpack mode.

Backpack chair 100 is also operable in the second or backpack mode as shown in FIG. 2. As implied by its name, the backpack mode is a mode in which backpack chair 100 is a backpack. That is, U-shaped frame 102 of backpack chair 100 can be carried as a backpack by hair service personnel from one location to another. More specifically, in this backpack mode, the two sides—namely first side 104 and second side 106—extend in the vertical plane while semicircular section 105 extends in a substantially horizontal plane H as shown in FIG. 3. In this mode, U-shaped frame 102 may form a storage receptacle.

Figure 4:
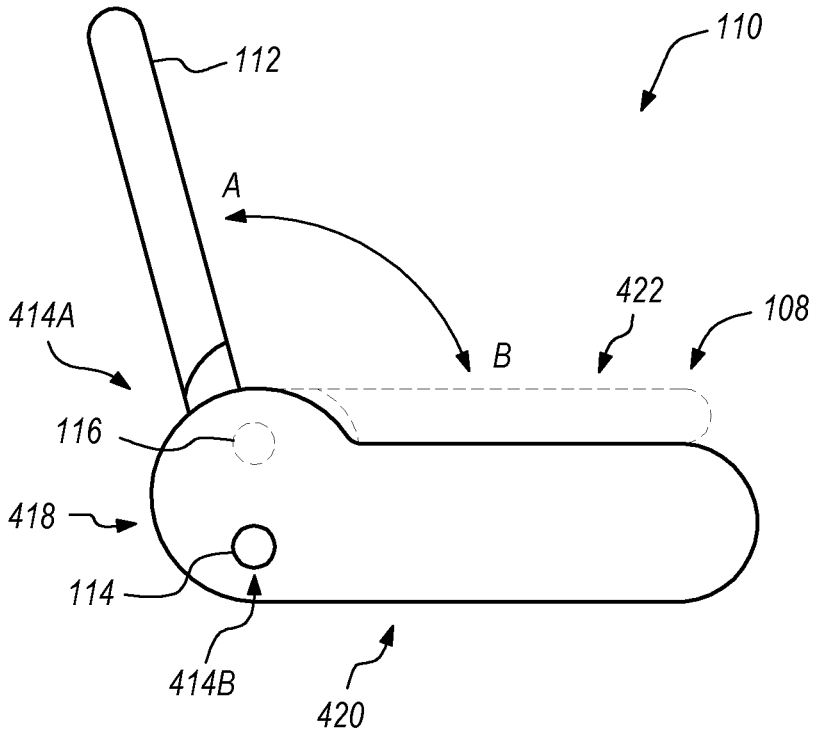
FIG. 4 is an example top member of the backpack chair of FIG. 1.

In FIG. 1 AND FIG. 4, backpack chair 100 further includes a top member 110 that includes a combined seat 108 and back support 112. In the sitting mode, top member 110 is attached to U-shaped frame 102 as in FIG. 1, and in the backpack mode, top member 110 is detached from U-shaped frame 102 as in FIG. 2. The detached top member 110 can then be stored in the receptacle formed by U-shaped frame 102. Thereafter, user 202 can carry the backpack chair 100 as a backpack as shown.

Referring to FIG. 1 and FIG. 4, seat 108 may include a shaft 114 and a hinge 116 that enables back support 112 to collapse on seat 108. Thus, back support 112 can be raised in the direction A so that back support 112 is upright and extends along vertical plane V, and that seat 108, which extends along horizontal plane H is perpendicular to back support 112. Back support 112 may also be lowered in the direction B for storage.

Figure 3A:
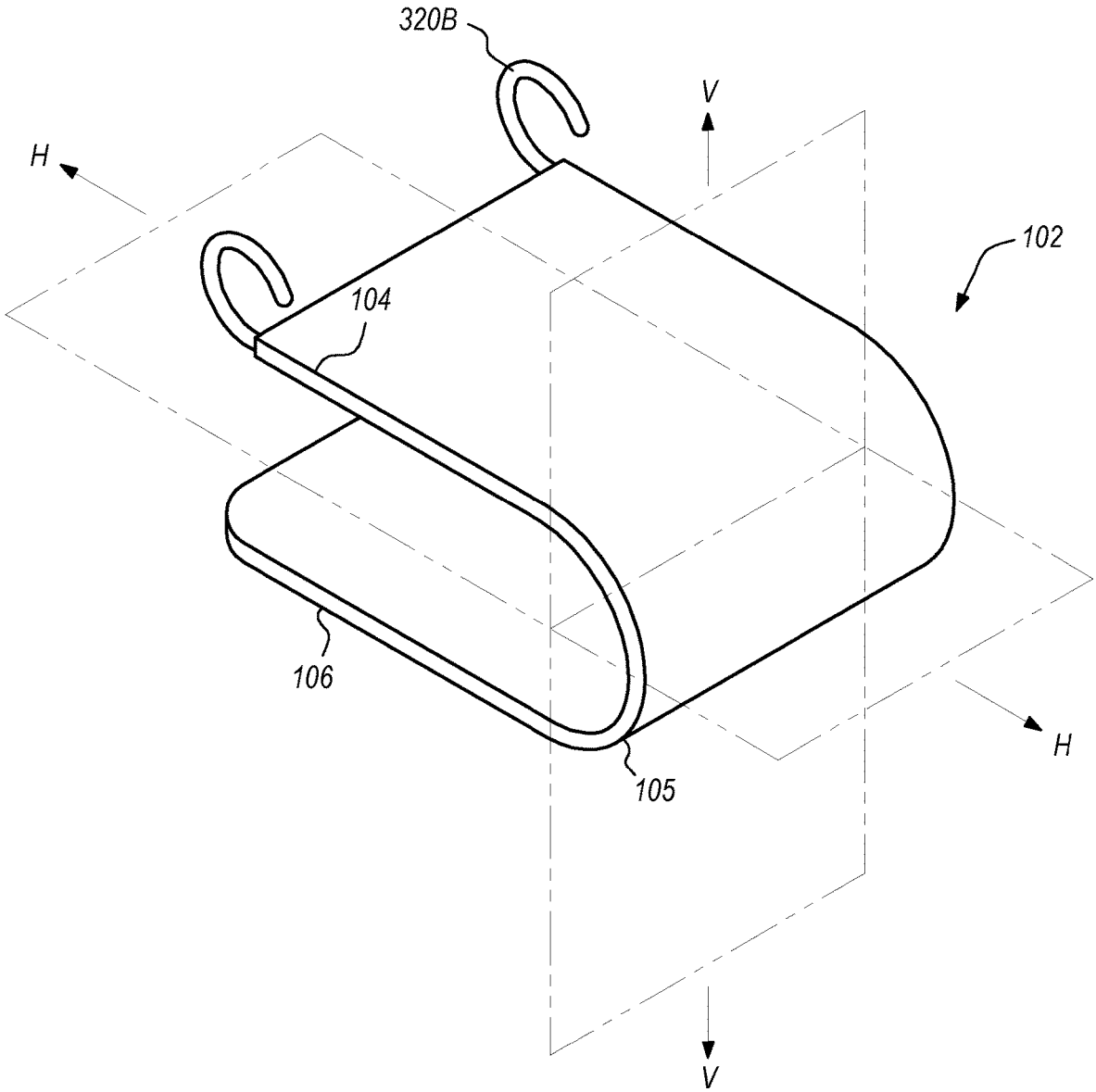
FIG. 3A is a side plan view of a U-shaped frame according to an example of the present disclosure.
Figure 3B:
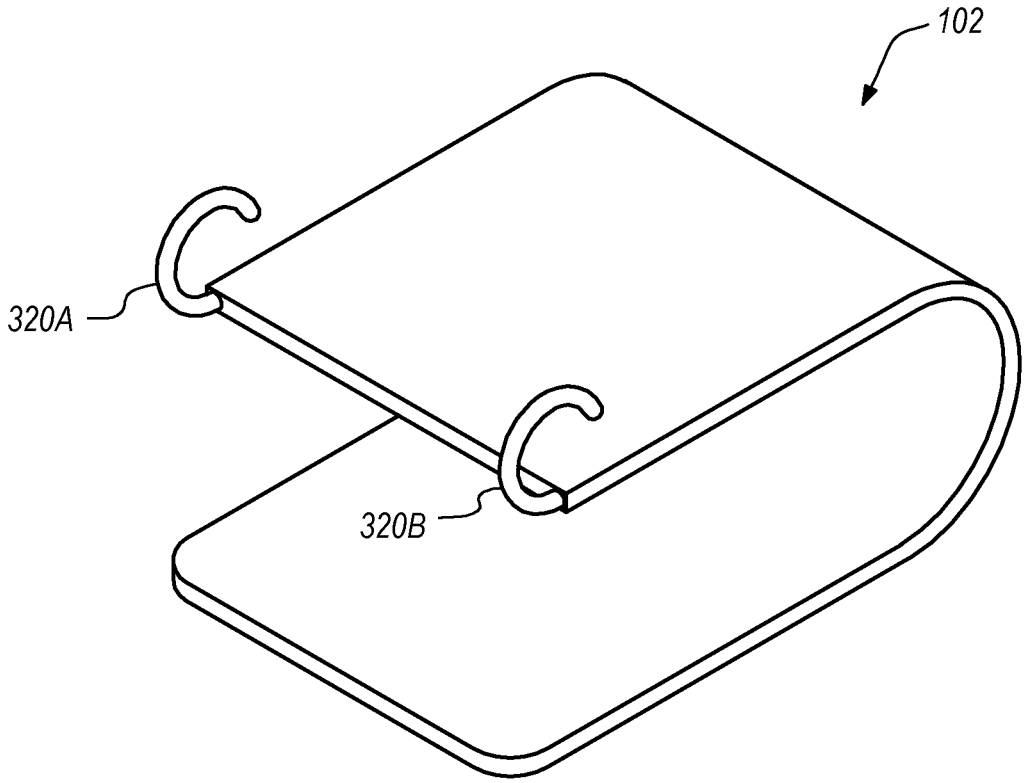
FIG. 3B is a perspective view of the U-shaped frame of FIG. 3A.

Shaft 114 is an elongated member that is attached to and extends from side-to-side, that is, in FIG. 4, from side 420 to side 422 along a back 418 of seat 108. Shaft 114 also protrudes generally one to three inches beyond each side 420 and side 422 of seat 108. In FIG. 4, a left-side protrusion 414B is shown. The right-side protrusion 414A is on the other end of shaft 114 indicated as 414A although not shown. As shown in FIG. 3B, right-side protrusion 414A can engage a right-side lip 320A while left-side protrusion 414B can engage a left-side lip 320B.

As can also be seen in FIG. 3B, right-side lip 320A and left-side lip 320B are mounted or formed on U-shaped frame 102 to engage the right-side protrusion 414A and left-side protrusion 414B of shaft 114 (FIG. 4) so as to secure top member 110 (FIG. 4) onto U-shaped frame 102 during a hair cutting session. Specifically, left-side lip 320B (FIG. 3B) engages left-side protrusion 414B while right-side lip 320A is to engage right-side protrusion 414A (FIG. 4). The result is that top member 110 is securely attached to U-shaped frame 102 as in FIG. 1.

In operation, in the sitting mode, top member 110 of FIG. 4, may be in a collapsed state with back support 112 laying on seat 108. Top member 110 is then positioned above U-shaped frame 102 (FIGS. 3A and 3B). Protrusions 414A and 414B are aligned and then engaged with respective lips 320A and 320B. Seat 108 is then placed on first side 104 of U-shaped frame 102. Back support 112 is raised to a vertical position and a user may thereafter sit on seat 108 for a hair cutting session.

Figure 5:
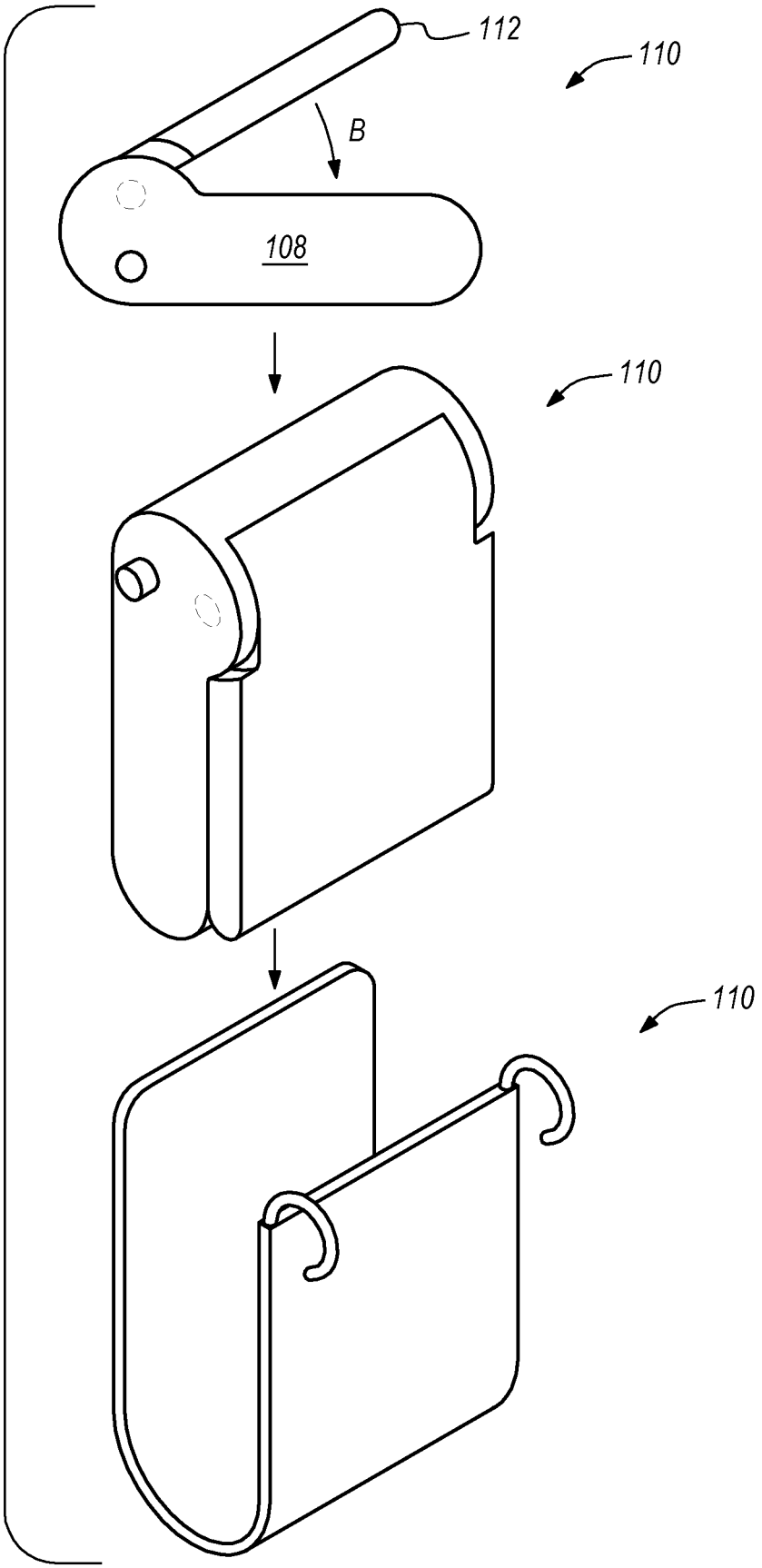
FIG. 5 illustrates insertion of the top member of FIG. 4 into the U-shaped frame according to an example of the present disclosure.

In the backpack mode, the steps described above are reversed. First, back support 112 is lowered in the direction B over seat 108 (FIG. 5). Top member 110 is then detached from U-shaped frame 102 by disengaging shaft 114 and protrusions 414A, 414B from lips 320A, 320B. The entirety of top member 110 is then inserted in U-shaped frame 102 which is inverted to form a receptacle. A pair of straps 204A, 204B with grommets 206 (FIG. 2) on the strap ends, the grommets 206 to engage lips 320A, 320B in the backpack mode, and to transport backpack chair 100.

Figure 6:
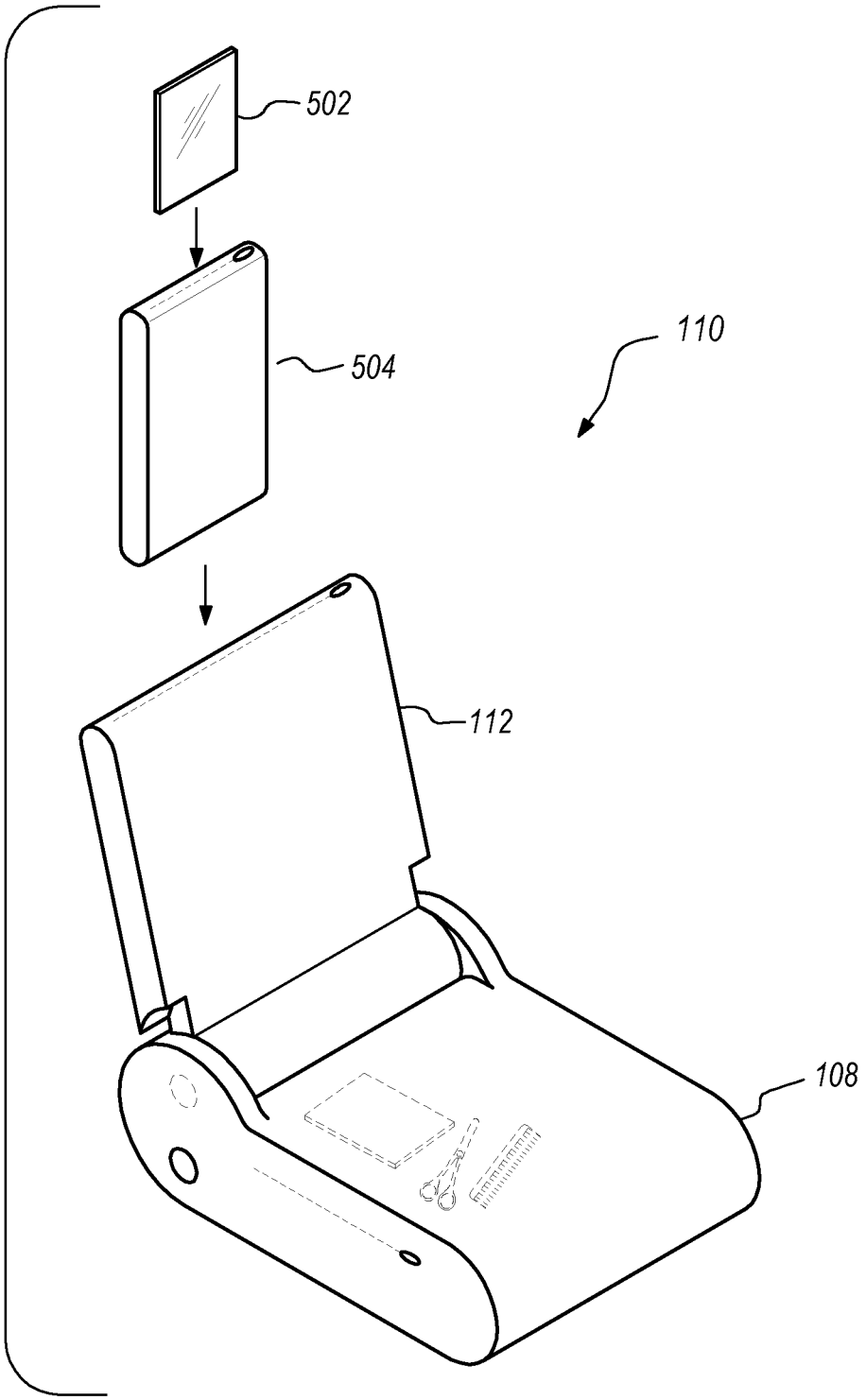
FIG. 6 illustrates an example top member for storing hair care implements.

FIG. 6 illustrates top member 110 according to an example of the present disclosure.

In FIG. 6, back support 112 and seat 108 are hollowed to each form a receptacle for storage. Here, back support 112 may include a sleeve 504 into which a hair cutting implement such as a mirror 502 is inserted for storage during the backpack mode. Seat 108 may include various padded partitions to store hair cutting implements such as a comb 602, a pair of scissors 604, clippers 606, for example.

While the above is a complete description of specific examples of the disclosure, additional examples are also possible. Thus, the above description should not be taken as limiting the scope of the disclosure, which is defined by the appended claims along with their full scope of equivalents.

I claim:

1. A backpack chair comprising:

a U-shaped frame to form a base for the backpack chair wherein the U-shaped frame has two sides connected to each other by a semicircular section in a sitting mode in which the backpack chair is for sitting, the two sides of the U-shaped frame extend in a horizontal plane and the semicircular section extends in a substantially vertical plane; and in a backpack mode wherein the backpack chair is carried as a backpack, the two sides extend in a vertical plane and the semicircular section extends in a substantially horizontal plane; and a top member that includes a combined seat and back support for the U-shaped frame, and in the sitting mode, the top member is attached to the U-shaped frame, and in the backpack mode, the top member is detached from the U-shaped frame.

2. The backpack chair of claim 1 wherein the seat and back support are planar and are adjacent to each other along an edge.

3. The backpack chair of claim 2 wherein the back support is collapsible on the seat along said edge.

4. The backpack chair of claim 2 further comprising a shaft extending along and attached to said edge.

5. The backpack chair of claim 4 further comprising a pair of lips mounted on the U-shaped frame, the lips to engage the shaft and to attach to or to detach from the top member of the U-shaped frame.

6. The backpack chair of claim 5 further comprising a pair of straps with grommets on the strap ends, the grommets to engage the lips in the backpack mode and to transport the chair as a backpack.

7. The backpack chair of claim 1 wherein in the sitting mode, the back support is upright and extends in a vertical plane and the seat extends in a horizontal plane and is perpendicular to the back support.

8. The backpack chair of claim 1 wherein in the backpack mode, the U-shaped frame is a receptacle, and the detached top member is stowed in the receptacle.

9. The backpack chair of claim 1 wherein a first of the two sides of the U-shaped frame is positioned on the ground to form legs of the backpack chair and a second side of the two sides is a surface to receive the seat.

10. The backpack chair of claim 1 wherein the back support includes a sleeve to store a mirror.

11. The backpack chair of claim 1 wherein the seat is hollowed to store tools.

12. A chair comprising:

a frame to form a base for the chair wherein the frame has walls to form a receptacle, and wherein in a sitting mode in which the chair is for sitting, the walls of the frame extend from a surface to receive a seat to a position on the ground to form legs of the chair and wherein in a backpack mode in which the chair is carried as a backpack, the walls of the frame extend in a vertical plane and no portion of the walls touch the ground when the chair is carried; and a top member that includes a combination of the seat and back support for the frame, wherein in the sitting mode, the top member is attached to the frame, and in the backpack mode, the top member is detached from the frame for storage in the receptacle formed by the frame.

13. The chair of claim 12 wherein the seat and back support are planar and are adjacent to each other along an edge.

14. The backpack chair of claim 13 wherein the back support is collapsible on the seat.

15. The backpack chair of claim 13 further comprising a shaft extending along said edge.

16. The backpack chair of claim 15 further comprising a pair of lips mounted on the frame, the lips to engage the shaft and to attach to or to detach from the top member of the frame.

17. The backpack chair of claim 16 further comprising a pair of straps with grommets on the strap, the grommets to engage the lips in the backpack mode and to transport the chair as a backpack.

18. The backpack chair of claim 12 wherein the back support includes a sleeve to store a mirror.

19. The backpack chair of claim 12 wherein the seat is hollowed to store tools.

* * * * *